US011817241B2

(12) United States Patent
Tsubokura et al.

(10) Patent No.: US 11,817,241 B2
(45) Date of Patent: Nov. 14, 2023

(54) MAGNET STRUCTURE

(71) Applicant: TDK Corporation, Tokyo (JP)

(72) Inventors: Taeko Tsubokura, Tokyo (JP); Toshihiro Kuroshima, Tokyo (JP); Koji Mitake, Tokyo (JP); Takeshi Masuda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 17/186,770

(22) Filed: Feb. 26, 2021

(65) Prior Publication Data

US 2021/0280345 A1 Sep. 9, 2021

(30) Foreign Application Priority Data

Mar. 3, 2020 (JP) ..... 2020-035938

(51) Int. Cl.
*H01F 1/057* (2006.01)
*H01F 41/02* (2006.01)

(52) U.S. Cl.
CPC ..... *H01F 1/0577* (2013.01); *H01F 41/0293* (2013.01)

(58) Field of Classification Search
None
See application file for complete search history.

(56) References Cited

U.S. PATENT DOCUMENTS

2012/0280775 A1* 11/2012 Nagata ..... C22C 38/06 427/127
2019/0115125 A1 4/2019 Tsubokura et al.

FOREIGN PATENT DOCUMENTS

GB 2497573 A * 6/2013 ..... B22F 3/24
JP 2019-075493 A 5/2019

OTHER PUBLICATIONS

Bomatec, Shearing Strength of NdFeB magnet. Nov. 1. 2019.*

* cited by examiner

*Primary Examiner* — Xiaowei Su
(74) *Attorney, Agent, or Firm* — Faegre Drinker Biddle & Reath LLP

(57) ABSTRACT

A magnet structure includes a first sintered magnet, a second sintered magnet, and an intermediate layer disposed between the first sintered magnet and the second sintered magnet. Each of the first sintered magnet and the second sintered magnet independently includes crystal grains containing a rare earth element, a transition metal element, and boron. The intermediate layer contains rare earth element oxide phases and crystal grains containing a rare earth element, transition metal element, and boron. Each of the transition metal elements independently includes Fe or a combination of Fe and Co. An average coverage factor of the rare earth element oxide phases measured on the basis of a cross section perpendicular to the intermediate layer of the magnet structure is within a range of 10% to 69%.

7 Claims, 3 Drawing Sheets

MAGNET STRUCTURE

TECHNICAL FIELD

The present disclosure relates to a magnet structure including a plurality of R-T-B-based permanent magnets having a rare earth element (R), a transition metal element (T) such as iron (Fe), and boron (B) as main components.

BACKGROUND

It is known that R-T-B-based (R is a rare earth element of one or more kinds, and T is a transition metal element such as Fe) permanent magnets have excellent magnetic characteristics.

For example, as described a method of obtaining one magnet structure by joining a plurality of R-T-B magnets is known.

RELATED BACKGROUND ART

Patent literature 1: Japanese Unexamined Patent Publication No. 2019-075493,

SUMMARY

There are cases in which magnet structures including a plurality of magnets are required to have further improved shearing strength in a joint portion.

An object of an aspect of the present invention is to provide a magnet structure having excellent shearing strength in a joint portion.

According to an aspect of the present invention, there is provided a magnet structure including a first sintered magnet, a second sintered magnet, and an intermediate layer disposed between the first sintered magnet and the second sintered magnet.

Each of the first sintered magnet and the second sintered magnet independently includes crystal grains containing a rare earth element, a transition metal element, and boron. The intermediate layer contains rare earth element oxide phases and crystal grains containing a rare earth element, a transition metal element, and boron. Each of the transition metal elements independently includes Fe or a combination of Fe and Co. An average coverage factor of the rare earth element oxide phases measured on the basis of a cross section perpendicular to the intermediate layer of the magnet structure is within a range of 10% to 69%.

Here, an average thickness of the rare earth element oxide phases may be within a range of 3 to 30 μm.

In addition, a c axis of the first sintered magnet and a c axis of the second sintered magnet may be non-parallel to each other.

In addition, a composition of the first sintered magnet and a composition of the second sintered magnet may differ from each other.

In addition, the average coverage factor may be within a range of 36% to 68%.

In addition, concentration of total rare earth elements in the rare earth element oxide phases may be within a range of 50 to 85 mass %.

In addition, the rare earth element in the rare earth element oxide phases may be at least one selected from the group consisting of Nd, Pr, Dy, Tb, Ho, and Gd.

DETAILED DESCRIPTION

Hereinafter, with reference to the drawings, a favorable embodiment of the present invention will be described. However, the present invention is not limited to the following embodiment.

<Magnet Structure>

Figure 1:
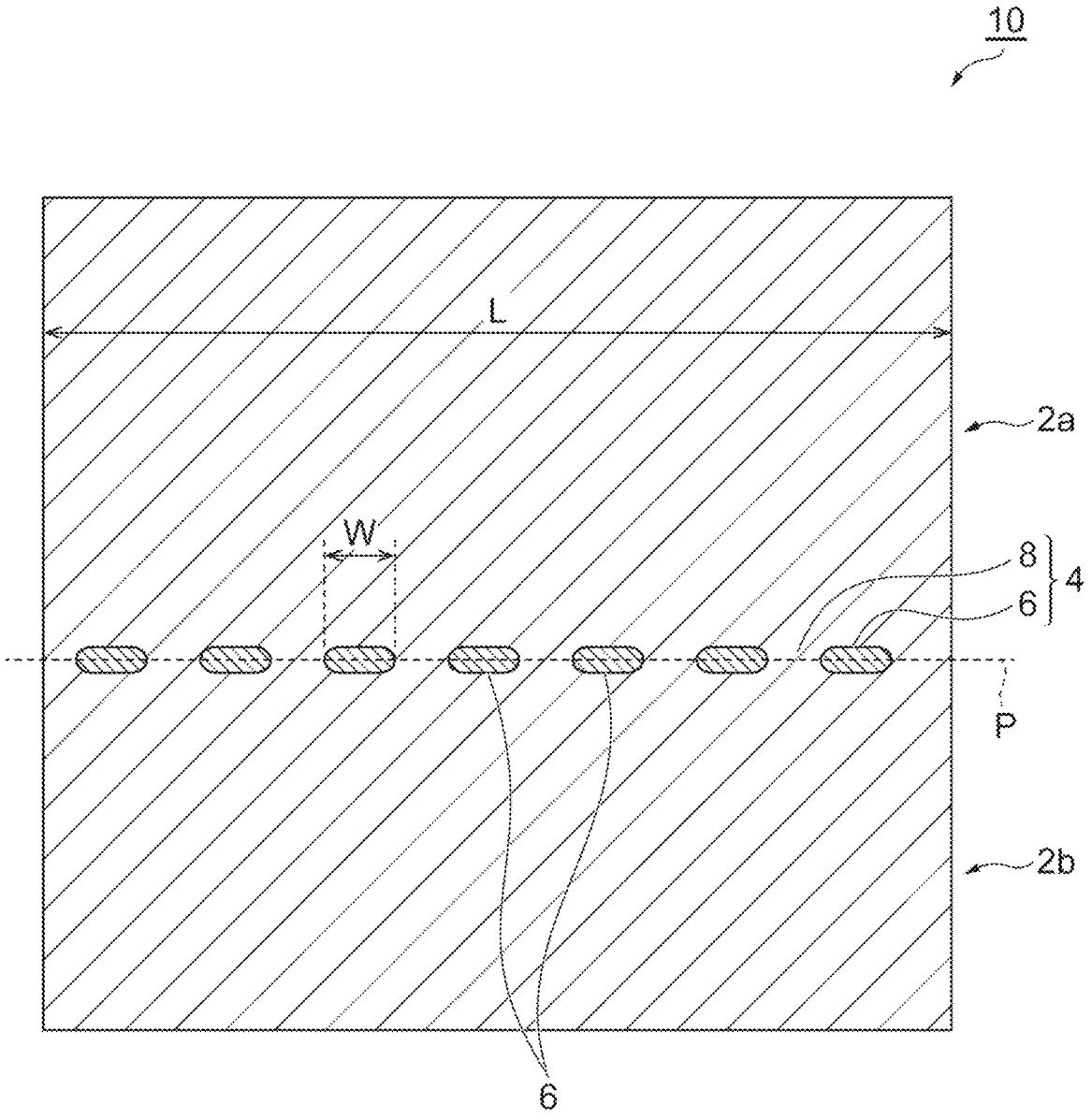
FIG. 1 is a schematic cross-sectional view perpendicular to an intermediate layer of a magnet structure 10 according to an embodiment of the present invention.

FIG. 1 is a schematic cross-sectional view of a magnet structure according to an embodiment of the present invention.

A magnet structure 10 includes a first sintered magnet 2*a*, a second sintered magnet 2*b*, and an intermediate layer 4 that is disposed between the first sintered magnet 2*a* and the second sintered magnet 2*b*.

(Sintered Magnet)

Each of the sintered magnets 2*a* and 2*b* is not particularly limited as long as it is independent R-T-B-based sintered magnet.

Each of the sintered magnets 2*a* and 2*b* is an R-T-B-based sintered magnet containing a rare earth element R, a transition metal element T, and boron B.

The "rare earth element" is at least one of Sc, Y, and lanthanoid elements that belong to Group III in the long-form periodic table. For example, lanthanoid elements include La, Ce, Pr, Nd, Sm, Eu, Gd, Tb, Dy, Ho, Er, Tm, Yb, Lu, and the like. Rare earth elements are classified into light rare earth elements and heavy rare earth elements. Heavy rare earth elements $R_H$ are Gd, Tb, Dy, Ho, Er, Tm, Yb, and Lu, and light rare earth elements $R_L$ are rare earth elements other than these.

In the present embodiment, R may include the light rare earth element $R_L$, may include neodymium (Nd) among these, and may further include other light rare earth element such as praseodymium (Pr).

Moreover, R may include the heavy rare earth element $R_H$. Since R includes the heavy rare earth element $R_H$, a coercive force of the magnets can be improved. $R_H$ may include at least one of dysprosium (Dy) and terbium (Tb) and may include Tb. $R_H$ may further include holmium (Ho) or gadolinium (Gd).

In the present embodiment, T includes Fe or a combination of Fe and cobalt (Co). When Co is included, temperature characteristics can be improved without magnetic characteristics deteriorating. In addition, T may further include copper (Cu). By including Cu, a high coercive force, high corrosion resistance, and improvement in temperature characteristics of an obtained magnet can be achieved.

Examples of the transition metal element other than Fe, Co, and Cu include Ti, V, Cr, Mn, Ni, Zr, Nb, Mo, Hf, Ta, W, and the like.

In addition, the sintered magnets 2*a* and 2*b* of the present embodiment may further contain at least one of elements, for example, selected from the group consisting of N, Al, Ga, Si, Bi, and Sn in addition to R, T, and B.

The sintered magnets 2*a* and 2*b* of the present embodiment have $R_2T_{14}B$ crystal grains (main phases), two grain boundaries formed between two adjacent $R_2T_{14}B$ crystal grains, and multiple grain boundaries surrounded by three or more adjacent $R_2T_{14}B$ crystal grains. In the present embodiment, grain boundaries include two grain boundaries and multiple grain boundaries. The $R_2T_{14}B$ crystal grains are grains having a crystal structure of $R_2T_{14}B$ tetragonal crystal. Generally, the average grain size of the $R_2T_{14}B$ crystal grains is within a range of approximately 1 μm to 30 μm. A volume fraction of the main phases can be 90% or more.

The sintered magnets of the present embodiment can include R-rich phases having a higher concentration (mass ratio) of R than the $R_2T_{14}B$ crystal grains (main phases) in grain boundaries. When grain boundaries include R-rich phases, a coercive force HcJ is likely to be manifested. Examples of R-rich phases include metal phases having a higher concentration of R than the main phases and lower concentrations of T and B than the main phases; metal phases individually having higher concentrations of R, Co, Cu, and N than the main phases; and oxide phases thereof. Each of the R-rich phases may include another element. Since grain boundaries include R-rich phases, there is a tendency for magnetic characteristics such as the coercive force of the magnet structure to be able to improve.

Moreover, grain boundaries may include B-rich phases having a higher concentration of boron (B) atoms than the main phases.

When T includes Fe and Co, the Co content in the sintered magnets may be within a range of 0.50 to 3.50 mass %, may be within a range of 0.70 to 3.00 mass %, and may be within a range of 1.00 to 2.50 mass %. In addition, when T includes Cu, the Cu content in the sintered magnets may be within a range of 0.05 to 0.35 mass %, may be within a range of 0.07 to 0.30 mass %, and may be within a range of 0.10 to 0.25 mass %. Since 0.50 mass % or more of Co and 0.05 mass % or more of Cu are contained, the corrosion resistance and the transverse strength of the magnet structure 10 are easily improved.

The R content in the sintered magnets of may be within a range of 25 mass % to 35 mass % and may be within a range of 28 mass % to 33 mass %. When the R content is 25 mass % or more, an $R_2T_{14}B$ compound that becomes the main phase of the magnets is likely to be sufficiently generated. In addition, when the R content is 35 mass % or less, decreases in the volume ratio of $R_2T_{14}B$ phases and decrease in residual magnetic flux density Br are able to be curbed.

The sintered magnets of the present embodiment may have a region in which the concentration of the heavy rare earth elements $R_H$ decreases as the distance from the intermediate layer 4 increases ($R_H$ gradient region).

When the sintered magnets 2*a* and 2*b* of the present embodiment include $R_H$, the $R_H$ content in R can be within a range of 0.1 to 1.0 mass %, for example. Since the $R_H$ content is 0.1 mass % or more, there is a tendency for the coercive force of the magnets to be able to improve. Since the $R_H$ content is 1.0 mass % or less, amount of heavy rare earth elements which are rare in terms of resources and expensive is decreased while a significant coercive force is obtained.

The B content in the sintered magnets of the present embodiment may be within a range of 0.5 mass % to 1.5 mass %, may be within a range of 0.7 mass % to 1.2 mass %, and may be within a range of 0.7 mass % to 1.0 mass %. When the B content is 0.5 mass % or more, there is a tendency for the coercive force HcJ to improve. In addition, when the B content is 1.5 mass % or less, there is a tendency for the residual magnetic flux density Br to improve. A part of B may be substituted with carbon (C).

Furthermore, the sintered magnets of the present embodiment may inevitably include oxygen (O), C, calcium (Ca), and the like. Each of these may be contained in the amount of approximately 0.5 mass % or less.

The Fe content in the sintered magnets of the present embodiment can be a substantial residue in constituent elements of the sintered magnets. Since T includes Co, not only the Curie temperatures of the sintered magnets are improved but the corrosion resistance is also improved. Therefore, the sintered magnets have high corrosion resistance in their entirety.

In addition, T may contain Cu. In this case, a high coercive force, high corrosion resistance, and improvement in temperature characteristics of the magnets can be achieved.

The sintered magnets of the present embodiment may contain aluminum (Al). Since the magnets contain Al, a higher coercive force, higher corrosion resistance, and better improvement in temperature characteristics can be achieved. The Al content may be within a range of 0.03 mass % to 0.4 mass % and may be within a range of 0.05 mass % to 0.25 mass %.

The sintered magnets of the present embodiment may contain oxygen (O). The amount of oxygen in the magnets varies depending on other parameters and the like, and the amount thereof is appropriately determined. However, it may be 500 ppm or more from the viewpoint of the corrosion resistance, and it may be 2,000 ppm or less from the viewpoint of the magnetic characteristics.

The sintered magnets of the present embodiment may contain carbon (C). The amount of carbon in the magnets varies depending on other parameters and the like, and the amount thereof is appropriately determined. However, when the amount of carbon increases, the magnetic characteristics deteriorate.

The sintered magnets of the present embodiment may contain nitrogen (N). The amount of nitrogen in the magnets may be within a range of 100 to 2,000 ppm, may be within a range of 200 to 1,000 ppm, and may be within a range of 300 to 800 ppm.

Regarding a method for measuring the amount of oxygen, the amount of carbon, and the amount of nitrogen in the sintered magnets, a method that is generally known in the related art can be used. For example, the amount of oxygen can be measured by an inert gas fusion-nondispersive infrared absorption method. For example, the amount of carbon can be measured by a combustion-in-oxygen airflow-infrared absorption method. For example, the amount of nitrogen can be measured by an inert gas fusion-thermal conductivity method.

In each of the first sintered magnet and the second sintered magnet, the volume fraction of the $R_2T_{14}B$ crystal grains (main phases) can be 90% or more.

The compositions of the first sintered magnet 2*a* and the second sintered magnet 2*b* may be compositions which are the same as each other or may be compositions which differ from each other.

For example, different compositions may denote that different kinds of R are contained or that different kinds of T are contained.

For example, a combination of the first sintered magnet 2*a* including the light rare earth element $R_L$, and the heavy rare earth element $R_H$ and the second sintered magnet 2*b* including the light rare earth element $R_L$, but not including the heavy rare earth element $R_H$ may be adopted. A combination of the first sintered magnet 2*a* and the second sintered magnet 2*b* in which the transition metal elements T thereof differ from each other, for example, T of one magnet includes cobalt and T of the other magnet includes no cobalt may be adopted. Magnets in which grain sizes of the main phases differ from each other may be adopted.

(Intermediate Layer)

The intermediate layer 4 is disposed between the first sintered magnet 2*a* and the second sintered magnet 2*b* and binds them together. The intermediate layer 4 contains rare earth element oxide phases 6 and RTB crystal grains 8 containing a rare earth element, a transition metal element, and boron.

As illustrated in FIG. 1, a plurality of rare earth element oxide phases 6 are disposed separately from each other in a dotted line shape in a cross section along an arbitrary reference plane P passing through the magnet structure 10, and the RTB crystal grains 8 containing a rare earth element, a transition metal element, and boron are disposed between the rare earth element oxide phases 6.

There is no particular limitation on the position of the reference plane P in a magnet structure. For example, when a magnet structure is a plate, the reference plane P can be disposed in a direction orthogonal to the thickness.

The rare earth element oxide phase 6 need only be phase of oxide of the rare earth element R, and may include the light rare earth element $R_L$, may include the heavy rare earth element $R_H$, or may include both. The rare earth element may be the same as the element included in the first sintered magnet and/or the second sintered magnet or may differ therefrom. The rare earth element in the rare earth element oxide phase 6 can be at least one selected from the group consisting of Nd, Pr, Dy, Tb, Ho, and Gd.

For example, the concentration of total rare earth elements R in the rare earth element oxide phases 6 can be within a range of 50 to 85 mass %, may be within a range of 60 to 80 mass %, or may be within a range of 50 to 85 mass %.

The proportion of atoms of $R_L$ in all the rare earth elements of the rare earth element oxide phases 6 may be zero, or for example, can be 40% or more, may be 60% or more, may be 80% or more, or may be 100%. Nd and Pr are favorable examples of the light rare earth element $R_L$.

At least one selected from the group consisting of Dy, Tb, Ho, and Gd is a favorable example of the heavy rare earth element $R_H$. The proportion of atoms of $R_H$ may be zero, or for example, can be 20% or more, may be 40% or more, may be 60% or more, or may be 100%.

In addition, the concentration of oxygen (O) in the rare earth element oxide phases is 3 mass % or more or may be 5 mass % or more. There is no limitation on the upper limit for the concentration of oxygen. However, for example, it can be 30 mass % or may be 25 mass %.

The rare earth element oxide phases 6 can have a plurality of regions having relatively different oxygen concentrations as long as they are oxides.

The intermediate layer 4 may further contain R-rich phases. The R-rich phases are metal phases mainly including R. The R-rich phases may include the light rare earth element $R_L$, may include the heavy rare earth element $R_H$, or may include both. For example, the concentration of R in the R-rich phases is within a range of 65 to 90 mass % or may be within a range of 70 to 85 mass %. In addition, the concentration of oxygen (O) in the R-rich phases is less than 3 mass % or may be 2 mass % or less.

The average coverage factor of the rare earth element oxide phases 6 is within a range of 10% to 69%. The average coverage factor can be 20% or more, can be 30% or more, can be 36% or more, can be 68% or less, or can be 65% or less.

As illustrated in FIG. 1, the average coverage factor of the rare earth element oxide phases 6 is defined as a value obtained by dividing the sum of widths W of the rare earth element oxide phases 6 included in a length L of a line segment (reference line) in a direction along a reference plane P in a photograph of a cross section perpendicular to the intermediate layer 4 (reference plane P) by the length L. It is favorable to adopt a value obtained by dividing the sum of the widths in the length L of the line segment (reference line) of approximately 2,500 μm, that is, measured in 10 photographs having the magnification of 500 times (approximately 250 μm of one side) by the overall lengths of 10 reference lines.

The average width of the rare earth element oxide phases 6 can be within a range of 5 to 40 μm, can be 10 μm or longer, or can be 35 μm or shorter.

Here, as illustrated in FIG. 1, the average width of the rare earth element oxide phases 6 is the arithmetical mean of the widths W of the rare earth element oxide phases 6 measured in a direction along the reference plane P in a photograph of a cross section perpendicular to the plane P, and the arithmetical mean of the widths W of approximately 100 rare earth element oxide phases 6 in photographs of 500 times (approximately 250 μm of one side) may be adopted by performing measurement.

In addition, the average thickness of the rare earth element oxide phases 6 can be within a range of 3 to 30 μm. The average thickness can be 5 μm or longer, can be 7 μm or longer, or can also be 10 μm or longer. In addition, the average thickness can be 26 μm or shorter, can be 24 μm or shorter, or can be 20 μm or shorter.

The average thickness of the rare earth element oxide phases 6 is measured as follows. As illustrated in FIG. 1, in a photograph of a cross section perpendicular to the plane P, 20 lines perpendicular to the intermediate layer 4 (plane P) are drawn at equal intervals, and the lengths of parts overlapping the rare earth element oxide phases 6 are measured. This step is performed with respect to ten photographs of cross sections at different portions in one magnet structure, and the arithmetical mean of the thicknesses at 200 places in total is adopted as the average thickness.

The magnification of a photograph of a cross section can be 500 times, that is, measurement can be performed such that each of the length and the width of a screen becomes approximately 250 μm. The places of the rare earth element oxide phases can be confirmed using an EDS or the like.

The RTB crystal grains 8 containing a rare earth element, a transition metal element, and boron are disposed between the rare earth element oxide phases 6. The RTB crystal grains 8 can be the $R_2T_{14}B$ crystal grains (main phases) described for the first sintered magnet and the second sintered magnet.

The rare earth element R in the RTB crystal grains 8 may include only the light rare earth element $R_L$, may include only the heavy rare earth element $R_H$, or may include both the light rare earth element $R_L$, and the heavy rare earth element $R_H$.

Nd and Pr are favorable examples of the light rare earth element $R_L$, in the rare earth element R in the RTB crystal grains 8.

At least one selected from the group consisting of Dy, Tb, Ho, and Gd is a favorable example of the heavy rare earth element $R_H$ in the rare earth element R in the RTB crystal grains 8.

The specific composition of the RTB crystal grains 8 may be the same as or may differ from that of the $R_2T_{14}B$ crystal grains of the first sintered magnet and/or the second sintered magnet.

T constituting the RTB crystal grains 8 of the intermediate layer 4 can be the same kind as T of the $R_2T_{14}B$ crystal grains of the first sintered magnet 2*a* or the second sintered magnet 2*b* or may differ therefrom.

R constituting the RTB crystal grains 8 of the intermediate layer 4 can be the same kind as T of the $R_2T_{14}B$ crystal grains of the first sintered magnet 2*a* or the second sintered magnet 2*b* or may differ therefrom.

For example, the thickness of the magnet structure 10 of the present embodiment can be within a range of 0.5 to 10.0 mm, may be within a range of 0.75 to 7.5 mm, or may be within a range of 1.0 to 5.0 mm.

A c axis of the first sintered magnet 2*a* and a c axis of the second sintered magnet 2*b* may be disposed parallel to each other. For example, each of the c axis of the first sintered magnet 2*a* and the c axis of the second sintered magnet 2*b* can be disposed perpendicular to the intermediate layer 4. A c axis is an easy axis of magnetization.

In addition, the c axis of the first sintered magnet 2*a* and the c axis of the second sintered magnet 2*b* may be disposed non-parallel to each other. Being non-parallel to each other means that an angle formed by the two c axes is other than 180 degrees. For example, 135 degrees, a right angle, or 45 degrees may be adopted. For example, the c axis of the first sintered magnet 2*a* can be disposed perpendicular to the intermediate layer 4, and the c axis of the second sintered magnet 2*b* and the intermediate layer 4 can form an angle of 45 degrees.

One magnet structure may have three or more sintered magnets, and the intermediate layer may be disposed between the sintered magnets respectively.

The $R_H$ content in the entire magnet structure 10 may be zero or may be within a range of 0.1 to 5.0 mass %.

In addition, the shape of the magnet structure is not limited to a plate shape and may be an arbitrary shape. The magnet structure may have a C-shape. In addition, an intermediate layer may be present in a curved shape instead of a plane shape.

(Effect)

As in the present embodiment, when the intermediate layer 4 has the rare earth element oxide phases 6 and the RTB crystal grains 8 and the coverage factor by the rare earth element oxide phases 6 is within a range of 10% to 69%, compared to when the coverage factor is excessively high, there is a tendency for shearing strength along a reference plane to increase.

Although the reason therefor is not clear, there is a possibility that an adequate amount of the rare earth element oxide phases 6 in the vicinity of the reference plane contributes to alleviation of stress.

In addition, in the magnet structure of the present embodiment, the corrosion resistance is high and deterioration in surface magnetic flux density is unlikely to occur compared to joining using an adhesive.

According to such a magnet structure, it is possible to obtain a magnet structure in which magnetic characteristics vary depending on the places (the first sintered magnet and the second sintered magnet). In addition, according to the present embodiment, it is possible to obtain a magnet structure having different directions of the c axis depending on the places.

<Method for Manufacturing Magnet Structure>

For example, the magnet structure 10 is manufactured through the following steps.

(A) A magnet preparing step of preparing R-T-B-based sintered magnets serving as the first sintered magnet and the second sintered magnet (Step S1)

(B) A paste preparing step of preparing a paste containing the rare earth element(s) R (diffusion material paste) (Step S2)

(C) A laminating step of applying the diffusion material paste to a main surface of the second sintered magnet to form a coating film and stacking the first sintered magnet onto the coating film to obtain a laminate (Step S3)

(D) A heating step of heating the laminate to obtain a magnet structure (Step S4)

(E) A surface treatment step of performing surface treatment of the magnet structure (Step S5)

Figure 2A:
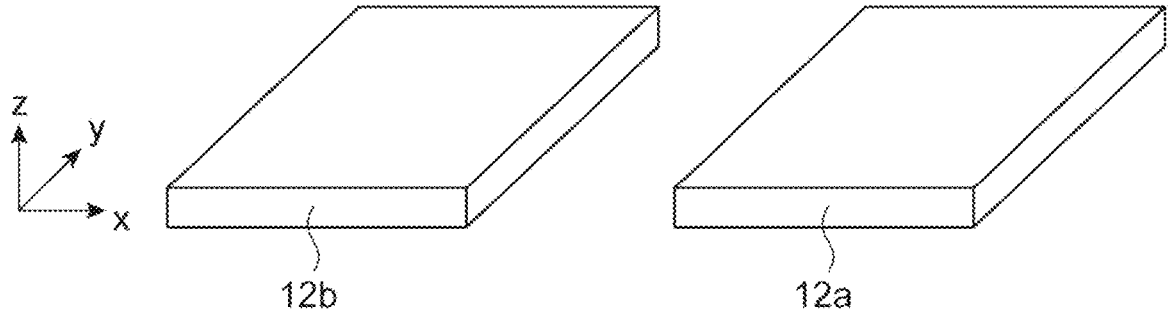
FIG. 2A is a perspective view illustrating a magnet preparing step of preparing two R-T-B-based sintered magnets in a step of manufacturing the magnet structure according to the embodiment of the present invention.
Figure 2B:
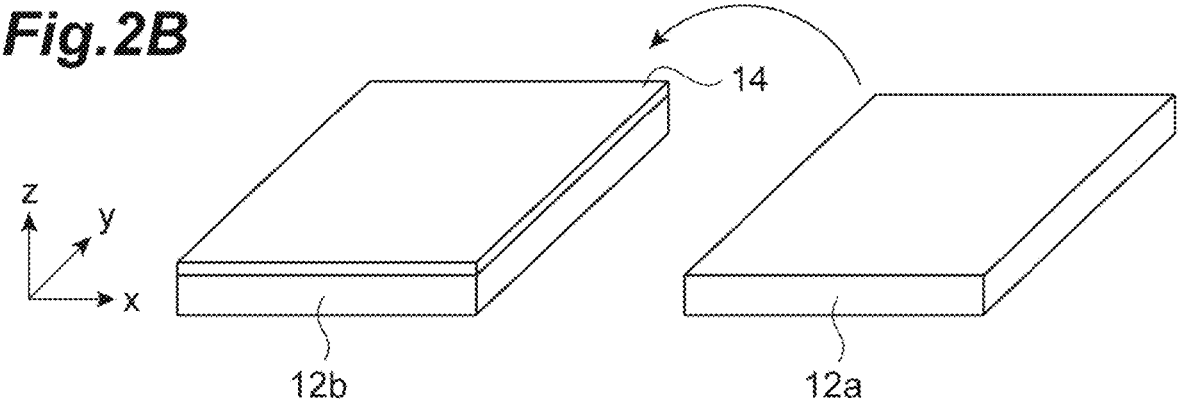
FIG. 2B is a perspective view illustrating a laminating step of applying a diffusion material paste to a second sintered magnet and stacking a first sintered magnet thereon in the step of manufacturing the magnet structure according to the embodiment of the present invention.
Figure 2C:
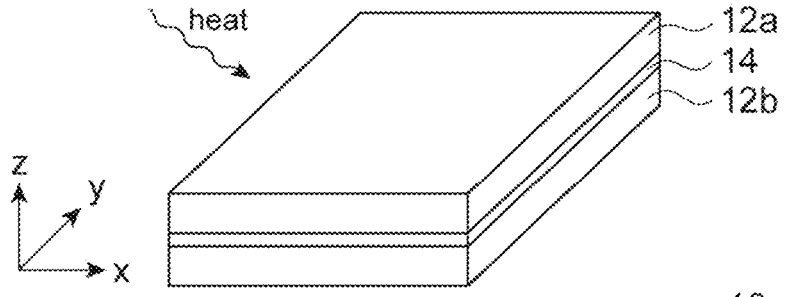
FIG. 2C is a perspective view illustrating a heating step of heating a laminate in the step of manufacturing the magnet structure according to the embodiment of the present invention.
Figure 2D:
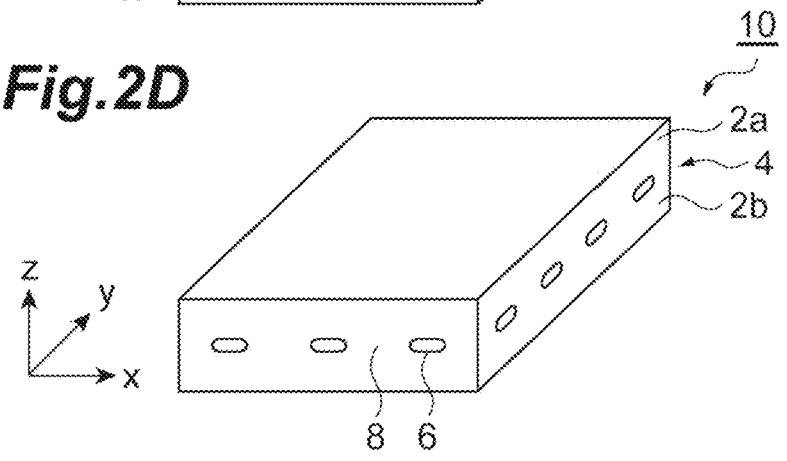
FIG. 2D is a perspective view illustrating a magnet structure obtained through the foregoing step in the step of manufacturing the magnet structure according to the embodiment of the present invention.

In addition, FIG. 2A is a perspective view illustrating the magnet preparing step of preparing the first sintered magnet and the second sintered magnet in a step of manufacturing a magnet structure according to the embodiment of the present invention (Step S1). FIG. 2B is a perspective view illustrating the laminating step of stacking the first sintered magnet onto the second sintered magnet coated with a diffusion material paste in the step of manufacturing the magnet structure according to the embodiment of the present invention (Step S3). FIG. 2C is a perspective view illustrating the heating step of heating the laminate in the step of manufacturing the magnet structure according to the embodiment of the present invention (Step S4). FIG. 2D illustrates a perspective view of the magnet structure 10 obtained through the foregoing steps in the step of manufacturing the magnet structure according to the embodiment of the present invention. Hereinafter, each of the steps will be described with reference to the drawings as necessary.

(Magnet Preparing Step: Step S1)

First, as illustrated in FIG. 2A, a first sintered magnet 12*a* and a second sintered magnet 12*b* are prepared. The first sintered magnet 12*a* and the second sintered magnet 12*b* mentioned here are magnets which serve as base materials before the heating step and will respectively become the first sintered magnet 2*a* and the second sintered magnet 2*b* in the magnet structure 10. Both the first sintered magnet 12*a* and the second sintered magnet 12*b* are R-T-B-based sintered magnets and may be the same as or differ from each other. Here, R of the magnets may include or may not include $R_L$, and/or $R_H$.

The sintered magnets may be prepared by purchasing commercially available sintered magnets. For example, they can be manufactured by a known method.

The shapes of the first sintered magnet 12*a* and the second sintered magnet 12*b* are not particularly limited. For example, it is possible to adopt a rectangular parallelepiped, a hexahedron, a flat plate shape, a prism shape such as a quadrangular prism, or an arbitrary shape in which a cross-sectional shape of an R-T-B-based sintered magnet is a C shape or a tube shape. The first sintered magnet 12*a* and the second sintered magnet 12*b* may have a substantially flat surface which will become a joining surface such that they can be joined to each other with the diffusion material paste therebetween.

(Paste Preparing Step: Step S2)

In the paste preparing step (Step S2), a paste containing the rare earth element R (diffusion material paste) is prepared. For example, a method for preparing a diffusion material paste has the following steps. The rare earth element R may be the heavy rare earth element(s) $R_H$, may be the light rare earth element(s) $R_L$, or may be a mixture thereof.

(a) A coarse pulverization step of coarse pulverizing a rare earth element containing material and obtaining rare earth element containing particles (b) An oxygen adhering step of causing oxygen to adhere to surfaces of the rare earth element containing particles and obtaining oxygen adhered rare earth element containing particles (c) A mixing step of obtaining a rare earth element containing paste In the coarse pulverization step, first, a single metal body of the rare earth element R or an alloy including the rare earth element R is prepared. In a case of an alloy, an alloy of a plurality of rare earth elements may be adopted, or an alloy of rare earth element and the foregoing transition metal element T may be adopted. The metal or alloy containing rare earth element R is subjected to coarse pulverizing until the particle size within a range of approximately several hundreds of μm to several mm is achieved. Accordingly, a coarsely pulverized powder of a metal or an alloy including the rare earth element R (rare earth element containing particles) is obtained.

Coarse pulverization can be performed by causing hydrogen to be stored in a rare earth element R containing metal or an alloy, discharging the hydrogen on the basis of the difference between the amounts of stored hydrogen having different phases thereafter, and inducing self-collapsing pulverization (hydrogen storage pulverization) through dehydrogenation.

In addition, the coarse pulverization step may be performed using a coarse grinder such as a stamp mill, a jaw crusher, or a Braun mill in inert gas atmosphere in addition to using hydrogen storage pulverization as described above.

In the oxygen adhering step, after a single body or an alloy of the rare earth element R is subjected to coarse pulverization, an obtained rare earth element containing powder is subjected to fine pulverization until the average particle size of approximately several μm is achieved. Accordingly, a fine pulverized powder containing rare earth element is obtained. The coarsely pulverized powder is further subjected to fine pulverization, and thus it is possible to obtain a fine pulverized powder, which may have a particle size within a range of 1 μm to 10 μm or within a range of 3 μm to 5 μm. Fine pulverization is performed in atmosphere containing oxygen of 3,000 to 10,000 ppm. Accordingly, oxygen can be adhered to the surfaces or the like of the rare earth element containing particles, and thus oxygen adhered rare earth element containing particles can be obtained.

Fine pulverization is performed by further pulverizing the coarsely pulverized powder using a fine-grinder such as a jet mill, a ball mill, a vibration mill, or a wet attritor while suitably adjusting conditions such as a pulverizing time. Using a jet mill is a pulverization method in which high-pressure inert gas (for example, $N_2$ gas) having an oxygen concentration within the foregoing range is released through a narrow nozzle, a high-speed gas flow is generated, the rare earth element containing particles are accelerated due to this high-speed gas flow, and causing a collision between the rare earth element containing particles or a collision with a target or a container wall.

When the rare earth element containing particles are subjected to fine pulverization, a fine pulverized powder having high orientation at the time of molding can be obtained by adding a pulverizing aid such as zinc stearate or oleic amide.

After oxygen is adhered to the surfaces of the rare earth element containing particles, the oxygen adhered rare earth element containing particles are mixed with a solvent, a binder, and the like in the mixing step. Accordingly, a rare earth element containing paste (also referred to as a diffusion material paste) is obtained. It is favorable that an oxygen containing compound such as silicone grease, oils and fats, or the like be not mixed in the diffusion material paste. When an oxygen containing compound increases, the amount of oxygen in the intermediate layer increases.

Examples of a solvent used in the diffusion material paste include aldehydes, alcohols, and ketones. In addition, examples of a binder include an acrylic resin, a urethane resin, a butyral resin, a natural resin, and a cellulose resin. For example, the rare earth element R content in the diffusion material paste can be within a range of 40 to 90 mass % or may be within a range of 50 to 80 mass %.

(Laminating Step: Step S3)

In the laminating step (Step S3), as illustrated in FIG. 2B, the diffusion material paste is applied on the main surface of the second sintered magnet 12*b*, and a coating film 14 of the diffusion material paste is formed. When the diffusion material paste includes a solvent, heat drying is performed after application in order to remove the solvent. Moreover, the first sintered magnet 12*a* is stacked onto the coating film 14 in a z direction in FIG. 2B, and thus a laminate is obtained. For example, the thickness of the coating film 14 of the diffusion material paste can be within a range of 5 to 50 μm or may be within a range of 10 to 35 μm. The coverage factor of the rare earth element oxide phases 6 can be adjusted by changing the thickness of the coating film 14.

(Heating Step: Step S4)

In the heating step (Step S4), as illustrated in FIG. 2C, the laminate obtained in the laminating step is heated. For example, heating is performed in a vacuum state or in inert gas atmosphere. The heating step may have first heating for diffusion of the rare earth element and second heating for improvement in coercive force as necessary. For example, the temperature of the first heating is within a range of 800° C. to 1,000° C., and the time is within a range of 10 minutes to 48 hours. In addition, for example, the temperature of the second heating is within a range of 500° C. to 600° C., and the time is within a range of 1 to 4 hours. Moreover, heating may be performed while vertically pressurizing the laminate in the z direction in FIG. 2C. Since heating is accompanied by pressurizing, there is a tendency for the joining strength between the magnets of the magnet structure to increase. As illustrated in FIG. 2D, the magnet structure 10 is obtained by heating the laminate obtained in the laminating step.

Through the first heating, the rare earth element R in the diffusion material paste diffuse in the first sintered magnet 12*a* and the second sintered magnet 12*b*. In addition, the rare earth element R, the transition metal element T, B, and the like in the first sintered magnet 12*a* and the second sintered magnet 12*b* are supplied to a part where the diffusion material paste had been present in a manner of replacing the diffused rare earth element R. Accordingly, the intermediate layer 4 including the rare earth element oxide phases 6 and the RTB crystal grains 8 is formed between the first sintered magnet 12*a* and the second sintered magnet 12*b*.

Here, in the paste preparing step (Step S2), since fine pulverization of the rare earth elements R is performed in oxygen containing atmosphere, oxygen is adhered to the rare earth element containing particles. In this manner, since a certain amount of oxygen is present in the diffusion material paste, the rare earth elements R are likely to be present as oxide, and thus the intermediate layer 4 contains the rare earth element oxide phases 6. The coverage factor of the rare earth element oxide phases 6 can vary in accordance with the coating amount of the paste, that is, the amount of the rare earth elements per unit area. For example, when the coating amount of the paste increases, the coverage factor increases, and when the coating amount of the paste decreases, the coverage factor decreases. In addition, the thicknesses and the widths of the rare earth element oxide phases can also be controlled in a similar manner.

(Surface Treatment Step: Step S5)

In the magnet structure 10 obtained in the foregoing step, surface treatment may be performed through plating, resin film coating, oxidation treatment, chemical treatment, or the like. Accordingly, the corrosion resistance of the magnet structure 10 can be further improved.

When the magnet structure 10 according to the present embodiment is used as a magnet for a rotating electric machine such as a motor, it can be used for a long period of time due to high corrosion resistance, thereby having high reliability. For example, the magnet structure 10 according to the present embodiment is favorably used as a magnet of a surface permanent magnet (SPM) motor in which the magnet is attached to a rotor surface, an interior permanent magnet (IPM) motor in which a magnet is embedded into a rotor, a permanent magnet reluctance motor (PRM), and the like. Specifically, the magnet structure 10 according to the present embodiment is favorably used for the purpose of a spindle motor for rotatively driving a hard disk of a hard disk drive, a voice coil motor, a motor for electric vehicles and hybrid cars, a motor for electric power steering of vehicles, a servo motor of machine tools, a motor for vibrators of portable telephones, a motor for printers, a motor for generators, and the like.

EXAMPLE

Hereinafter, the present embodiment will be described in more detail using examples. However, the present invention is not limited to the following examples.

<Making Sintered Magnet>

First, raw material alloys were prepared by a strip casting method to obtain sintered magnets having the magnet composition (mass %) shown in Table 1. In Table 1, "bal." indicates the balance when the entire magnet composition is 100 mass %, and "TRE" indicates the total mass % of Nd and Pr which are light rare earth elements.

TABLE 1

| | Nd | Pr | TRE | Co | Al | Cu | Zr | B | Fe |
|---|---|---|---|---|---|---|---|---|---|
| mass % | 23.6 | 7.4 | 31.0 | 1.0 | 0.2 | 0.1 | 0.15 | 0.98 | Bal. |

Next, after hydrogen was stored in each of the raw material alloys, hydrogen pulverization treatment (coarse pulverization) of dehydrogenation was performed at 600° C. for 1 hour under Ar atmosphere.

In the present example, each of the steps (fine pulverization and molding) from this hydrogen pulverization treatment to sintering was performed under Ar atmosphere having an oxygen concentration lower than 50 ppm (the same applies to the following examples and the comparative examples).

Next, zinc stearate of 0.1 mass % was added to the coarsely pulverized powder as a pulverizing aid before fine pulverization was performed after hydrogen pulverization, and they were mixed using a Nauta mixer. Thereafter, fine pulverization was performed using a jet mill, and a fine pulverized powder having the average particle size of approximately 4.0 μm was obtained.

A die was filled with the obtained fine pulverized powder, in-magnetic field molding of applying a pressure of 120 MPa was performed while applying a magnetic field of 1,200 kA/m, and molded bodies were obtained.

Thereafter, after the obtained molded bodies were held to bake at 1,060° C. for 4 hours in a vacuum state, they were subjected to rapid cooling, and sintered bodies (R-T-B-based sintered magnet) having the magnet composition shown in Table 1 were obtained. Further, the obtained sintered bodies were subjected to aging treatment in two stages, such as at 850° C. for 1 hour and at 540° C. for 2 hours (both under Ar atmosphere), and sintered magnets as base materials to be used for examples and the comparative examples were obtained.

<Making Magnet Structure>

Example 1

After a Tb metal (purity of 99.9%) as the heavy rare earth element $R_H$ was subjected to hydrogen occlusion, hydrogen pulverization treatment (coarse pulverization) of dehydrogenation was performed under at 600° C. for 1 hour in Ar atmosphere. Next, zinc stearate of 0.1 mass % was added to the coarsely pulverized powder as a pulverizing aid, and they were mixed using a Nauta mixer. Thereafter, fine pulverization was performed using a jet mill in atmosphere including oxygen of 3,000 ppm, and a fine pulverized powder having the average particle size of approximately 4.0 μm was obtained. 23 parts by mass of alcohol as a solvent and 2 parts by mass of an acrylic resin as a binder were added to 75 parts by mass of the fine pulverized powder, and a diffusion material paste including $TbH_2$ as a diffusion material was made.

Two magnets obtained by machining the sintered magnets obtained as described above in a size of the length 11 mm×the width 11 mm×the thickness 4 mm were prepared. The thickness direction and the c axis of each magnet coincided with each other. After each of the magnets was cleaned with an aqueous solution having nitric acid of 0.3%, aqueous cleaning and drying were performed. One main surface within two magnets was coated with a diffusion material paste, the remaining main surface of the base material was overlapped on the coated main surface, the coated magnets were left behind in an oven at 160° C., and the solvent in the paste was removed. While a load of 25 g was applied to the laminate from thereabove, heating was performed at 900° C. for 6 hours in Ar atmosphere (first heating). Moreover, the laminate after the first heating was heated at 540° C. for 2 hours in Ar atmosphere (second heating), and the magnet structure of Example 1 was obtained. Table 2 shows the kind of the diffusion material included in the diffusion material paste and the amounts of Tb and Nd in the diffusion material paste. The amounts of Tb and Nd in the diffusion material paste were determined based on the mass of the entire magnet structure.

Examples 2 and 3

Magnet structures of Examples 2 and 3 were obtained in a manner similar to that of Example 1 except that the amount of R (Tb) in the diffusion material paste was changed as described in Table 2.

Examples 4 to 6

TbNdCu was used as the diffusion material. Specifically, diffusion material pastes were made in a manner similar to that of Example 1 except that the composition was adjusted to achieve Tb:Nd:Cu=50:20:30 (at %) and a TbNdCu alloy was made by a strip casting method.

Magnet structures of Examples 4 to 6 were obtained in a manner similar to that of Example 1 except that the amount of R (Tb and Nb) in the diffusion material was changed as described in Table 2.

Example 7

Nd was used as the diffusion material. Specifically, a diffusion material paste was made in a manner similar to that of Example 1 except that a Nd metal (99.9%) was used. A magnet structure of Example 7 was obtained in a manner similar to that of Example 1 except that the amount of R (Tb and Nb) in the diffusion material was adjusted as described in Table 2.

Example 8

This was made in a manner similar to that of Example 7 except that the c axis of one magnet was tilted by 45 degrees with respect to the main surface.

Comparative Examples 1 and 2

One magnet was prepared by machining the obtained sintered magnet in a size of the length 11 mm×the width 11 mm×the thickness 8 mm. Magnets of Comparative Examples 1 and 2 were obtained in a manner similar to that of Example 1 except that each of the main surface and the rear surface of the magnet were coated with the same diffusion material paste as the diffusion material paste used in Example 1, it was not laminated with another magnet, and no load was applied at the time of heat treatment. Each of the amounts of Tb and Nd included in the diffusion material paste was adjusted as described in Table 2.

Comparative Example 3

A magnet structure of Comparative Example 3 was obtained in a manner similar to that of Example 1 except that the amount of R (Tb) in the diffusion material was changed as described in Table 2.

Comparative Example 4

A magnet structure of Comparative Example 4 was obtained in a manner similar to that of Example 4 except that the amount of R (Tb and Nb) in the diffusion material was changed as described in Table 2.

Comparative Example 5

This was made in a manner similar to that of Example 1 except that the main surfaces of two magnets were bonded to each other using an epoxy adhesive (thickness of 50 μm) without using a diffusion material paste and heat treatment.

Comparative Examples 6 and 7

$TbF_3$ was used as the diffusion material. Specifically, a diffusion material paste including $TbF_3$ as a diffusion material was made by adding 23 parts by mass of alcohol as a solvent and 2 parts by mass of an acrylic resin as a binder using commercially available $TbF_3$ in a manner similar to that of Example 1. Magnet structures of Comparative Examples 6 and 7 were obtained in a manner similar to that of Example 1 except that the amount of R (Tb) in the diffusion material was adjusted as described in Table 2.

Comparative Example 8

This was made in a manner similar to that of Example 1 except that no diffusion material paste was used.

<Evaluation of Magnet Structure>

(Making Cross Section)

Central portion on the main surfaces of the magnet structures and the like obtained in the examples and the comparative examples were cut in the thickness direction in a size of the length 11 mm×the width 5.5 mm and machining was performed. The machined magnet structures were buried in resins, and surface polishing of cross sections of the magnet structures was performed.

(Distribution of Elements in Intermediate Layer)

Regarding a joint part in a cross section, the distribution of elements was analyzed using an EDS (manufactured by Oxford Instruments plc. the product name: Aztec-3.3). In Examples 1 to 8 and Comparative Examples 3 and 4, the presence of the intermediate layer having rare earth element oxide phases and RTB crystal grains was confirmed. In Examples 1 to 8 and Comparative Examples 3 and 4, the concentration of total rare earth elements was approximately 50~85 mass % in the rare earth element oxide phases. The rare earth elements in the rare earth element oxide phases in Examples 1 to 6 and Comparative Examples 6 and 7 were Nd, Pr, and Tb, and the rare earth elements in the rare earth element oxide phases in Example 7 to 8 were Nd and Pr.

(Average Thickness of Intermediate Layer)

The intermediate layer part in a cross section was observed at a magnification of 500 times using a scanning electron microscope (manufactured by JEOL, FE-SEM (JSM-IT300HR)).

Figure 3:
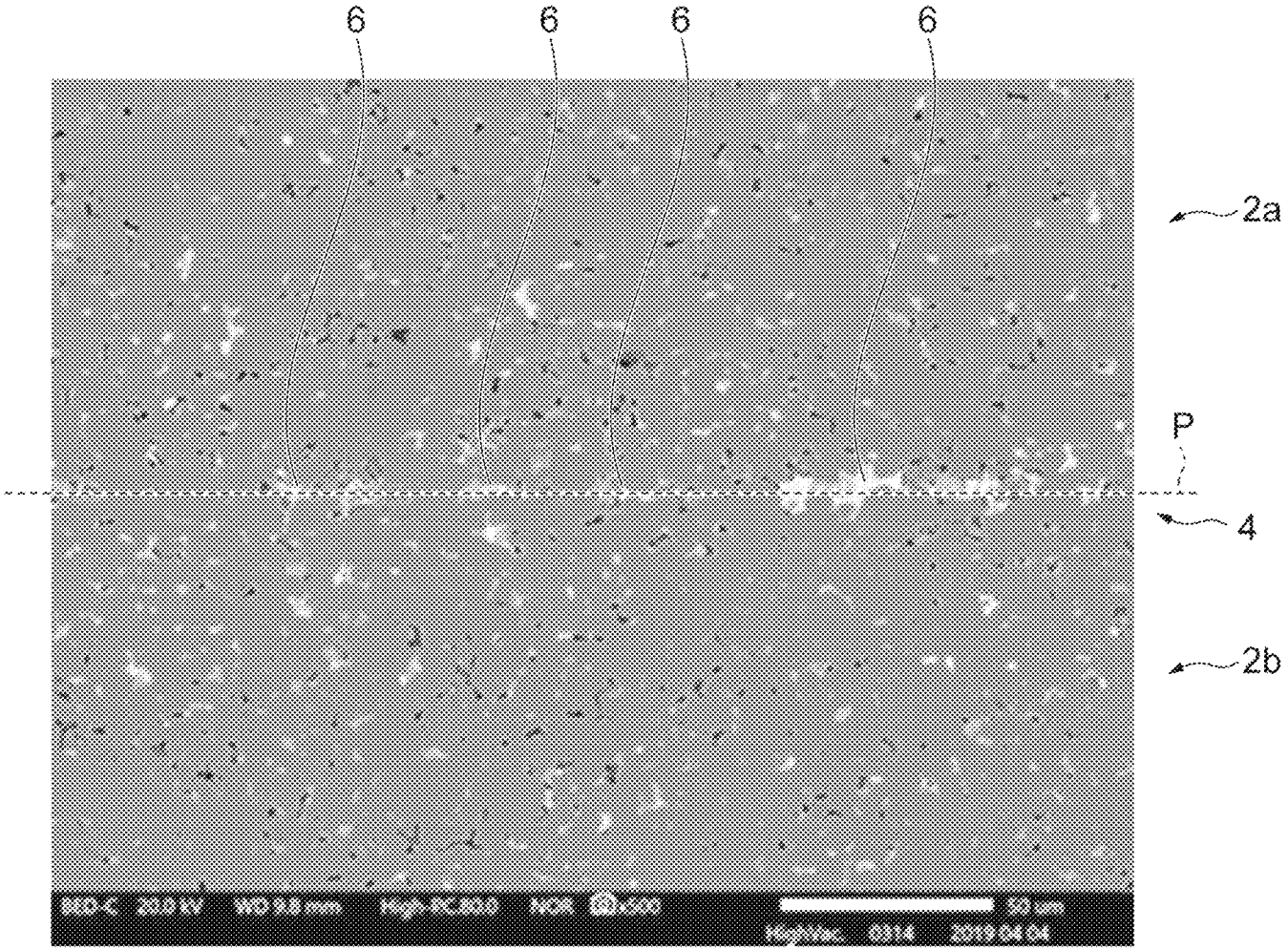
FIG. 3 is an SEM photograph of a cross section of a magnet structure according to Example 4.

Using image analysis software (PIXS2000pro), 20 lines perpendicular to the intermediate layer were drawn at equal intervals, and lengths of parts overlapping the rare earth element oxide phases were individually measured. This step was performed with respect to ten photographs of cross sections at different portions in one magnet structure, the arithmetical mean of the thicknesses at 200 places in total was adopted as the average thickness. FIG. 3 illustrates an example of an SEM photograph in Example 4.

(Average Coverage Factor by Intermediate Layer)

The intermediate layer part in a cross section was observed at a magnification of 500 times using a scanning electron microscope (manufactured by JEOL, FE-SEM (JSM-IT300HR)). After the color of the rare earth element oxide phases was confirmed in advance using an EDS, the sum of the widths of the rare earth element oxide phases 6 measured in a direction along the reference line (a direction in which the intermediate layer extends) was obtained for ten screens and was divided by the overall length of the reference lines of ten screens. The arithmetical mean of the widths was also indicated.

(Shearing Strength Test)

For a shearing strength test, a large-sized magnet structure in which the size of one sintered magnet was set to the length of 50 mm, the width of 4.5 mm, and the thickness of 8 mm was made in each of the examples and the comparative examples.

Further, the shearing strength test performed with respect to the magnet structure based on JIS K6852. An average value of n=10 was indicated by setting a load cell to 1 ton and setting a rate of loading to 10 mm/min A shearing direction was a direction parallel to the intermediate layer.

(Corrosion Resistance)

The magnet structures and the like obtained in the examples and the comparative examples were machined in a size of the length 10.6 mm×the width 10.6 mm. The machined magnet structures were left behind for 200 hours in saturated vapor atmosphere at 120° C., 2 atm, and relative humidity of 100%, and the amount of mass decrease due to corrosion was measured. The results of measurement value evaluated in accordance with the following standard were indicated.

A: less than 2.0 mg/cm$^2$

B: the amount of mass decrease within a range of 2.0 mg/cm$^2$ or more and less than 5.0 mg/cm$^2$ C: the amount of mass decrease of 5.0 mg/cm$^2$ or more (Magnetic Characteristics)

The magnetic characteristics of the magnet structures and the like obtained in the examples and the comparative examples were measured using a B-H tracer. The residual magnetic flux density Br and the coercive force HcJ were measured as the magnetic characteristics. Table 3 shows the measurement results.

(Surface Magnetic Flux Density)

The surface magnetic flux density at the center on the main surface facing the intermediate layer in the magnet structure was obtained.

A value obtained by subtracting the surface magnetic flux density of the solid (non-joint) magnet of Comparative Example 1 from the surface magnetic flux density of each example and making it non-dimensional ratio based on the surface magnetic flux density of Comparative Example 1 is shown in Table as the surface magnetic flux density of each example.

Table 3 shows the results thereof.

TABLE 2

| | Method for forming intermediate layer | Orientation of c axis with respect to plate thickness direction of magnet: First magnet | Second magnet | Diffusion material | Amount of Tb and Nd in diffusion material paste based on mass of magnet structure (mass %): Tb | Nd | Coating place of diffusion material paste |
|---|---|---|---|---|---|---|---|
| Example 1 | Diffusion of R between magnets | Parallel | Parallel | $TbH_2$ | 0.1 | 0.00 | Between two magnets |
| Example 2 | Diffusion of R between magnets | Parallel | Parallel | $TbH_2$ | 0.2 | 0.00 | Between two magnets |
| Example 3 | Diffusion of R between magnets | Parallel | Parallel | $TbH_2$ | 0.3 | 0.00 | Between two magnets |
| Example 4 | Diffusion of R between magnets | Parallel | Parallel | TbNdCu | 0.1 | 0.04 | Between two magnets |
| Example 5 | Diffusion of R between magnets | Parallel | Parallel | TbNdCu | 0.2 | 0.07 | Between two magnets |
| Example 6 | Diffusion of R between magnets | Parallel | Parallel | TbNdCu | 0.3 | 0.11 | Between two magnets |
| Example 7 | Diffusion of R between magnets | Parallel | Parallel | Nd | 0 | 0.10 | Between two magnets |
| Example 8 | Diffusion of R between magnets | Parallel | 45 degrees | Nd | 0 | 0.10 | Between two magnets |
| Comparative Example 1 | None (non-joint and solid product) | Parallel | | $TbH_2$ | 0.6 | 0.00 | Both outer surfaces |
| Comparative Example 2 | None (non-joint and solid product) | Parallel | | $TbH_2$ | 0.3 | 0.00 | Both outer surfaces |
| Comparative Example 3 | Diffusion of R between magnets | Parallel | Parallel | $TbH_2$ | 0.6 | 0.00 | Between two magnets |
| Comparative Example 4 | Diffusion of R between magnets | Parallel | Parallel | TbNdCu | 0.6 | 0.22 | Between two magnets |
| Comparative Example 5 | Epoxy resin adhesive | Parallel | 45 degrees | None | — | — | — |
| Comparative Example 6 | Diffusion of R between magnets | Parallel | Parallel | $TbF_3$ | 0.2 | 0.00 | Between two magnets |
| Comparative Example 7 | Diffusion of R between magnets | Parallel | Parallel | $TbF_3$ | 0.6 | 0.00 | Between two magnets |
| Comparative Example 8 | Sintering | Parallel | Parallel | None | — | — | — |

TABLE 3

| | Intermediate layer | Rare earth element oxide phases Thickness (μm) | Width (μm) | Coverage factor (%) | Shearing strength (MPa) | Corrosion resistance | Ratio of decrease in surface magnetic flux density (%) | Br (mT) | HcJ (kA/m) |
|---|---|---|---|---|---|---|---|---|---|
| Example 1 | R oxide phases and RTB crystal grain phases | 7 | 24 | 52 | 35.6 | A | — | 1427 | 1616 |
| Example 2 | R oxide phases and RTB crystal grain phases | 12 | 27 | 58 | 31.9 | A | — | 1424 | 1781 |
| Example 3 | R oxide phases and RTB crystal grain phases | 21 | 32 | 65 | 28.8 | A | — | 1421 | 1889 |
| Example 4 | R oxide phases and RTB crystal grain phases | 9 | 26 | 56 | 34.9 | A | — | 1425 | 1622 |
| Example 5 | R oxide phases and RTB crystal grain phases | 14 | 30 | 62 | 31.2 | A | — | 1423 | 1788 |
| Example 6 | R oxide phases and RTB crystal grain phases | 24 | 34 | 68 | 27.8 | A | — | 1420 | 1905 |
| Example 7 | R oxide phases and RTB crystal grain phases | 8 | 11 | 36 | 36.1 | A | — | 1429 | 1419 |
| Example 8 | R oxide phases and RTB crystal grain phases | 8 | 11 | 36 | 36.1 | A | −2.1 | — | — |
| Comparative Example 1 | None | 0 | 0 | 0 | 38.8 | — | 0.0 | 1414 | 1998 |
| Comparative Example 2 | None | 0 | 0 | 0 | 38.9 | — | — | 1423 | 1879 |
| Comparative Example 3 | R oxide phases and RTB crystal grain phases | 30 | — | 94 | 14.6 | A | — | 1412 | 2018 |
| Comparative Example 4 | R oxide phases and RTB crystal grain phases | 33 | — | 96 | 14.3 | A | — | 1410 | 2026 |
| Comparative Example 5 | Epoxy resin adhesive cured product | — | — | — | 7.0 | C | −10.0 | — | — |
| Comparative Example 6 | Not formed (not joinable) | — | — | — | — | — | — | — | — |
| Comparative Example 7 | Not formed (not joinable) | — | — | — | — | — | — | — | — |
| Comparative Example 8 | Not formed (not joinable) | — | — | — | — | — | — | — | — |

In each of the examples and Comparative Examples 3 and 4, formation of an intermediate layer having the rare earth element oxide phases and the RTB crystal grains along the joined surface was confirmed. In contrast, when fluorides were used as in Comparative Examples 6 and 7, and when a diffusion material including the rare earth element was not used as in Comparative Example 8, an intermediate layer including the rare earth element oxide phases and the RTB crystal grains was not formed, and thus the magnets could not be joined to each other.

When they were joined to each other using an epoxy resin adhesive as in Comparative Example 5, the shearing strength was weak, deterioration in the surface magnetic flux density was significant, and the corrosion resistance was also poor.

In addition, when the coverage factor of the rare earth element oxide phases was high as in Comparative Examples 3 and 4, the shearing strength decreased.

In contrast, when the coverage factor of the rare earth element oxide phases was low as in the examples, the shearing strength was significant, and the corrosion resistance was also sufficient.

What is claimed is:

1. A magnet structure comprising:

a first sintered magnet;

a second sintered magnet; and an intermediate layer disposed between the first sintered magnet and the second sintered magnet, wherein each of the first sintered magnet and the second sintered magnet independently includes crystal grains containing a rare earth element, a transition metal element, and boron, the intermediate layer contains rare earth element oxide phases and crystal grains containing a rare earth element, a transition metal element, and boron, each of the transition metal elements independently includes Fe or a combination of Fe and Co, an average coverage factor of the rare earth element oxide phases of the intermediate layer measured on the basis of a cross section perpendicular to the intermediate layer of the magnet structure is within a range of 10% to 69%, and a compressive shearing strength of the magnet structure is 27.8 MPa or more and 36.1 MPa or less, wherein the compressive shearing strength is tested based on Japanese Industrial Standard K6852 using a shearing direction parallel to the intermediate layer and a rate of loading set to 10 mm/min.

2. The magnet structure according to claim 1, wherein an average thickness of the rare earth element oxide phases is within a range of 3 to 30 μm.

3. The magnet structure according to claim 1, wherein a c axis of the first sintered magnet and a c axis of the second sintered magnet are non-parallel to each other.

4. The magnet structure according to claim 1, wherein a composition of the first sintered magnet and a composition of the second sintered magnet differ from each other.

5. The magnet structure according to claim 1, wherein the average coverage factor is within a range of 36% to 68%.

6. The magnet structure according to claim 1, wherein concentration of total rare earth elements in the rare earth element oxide phases are within a range of 50 to 85 mass %.

7. The magnet structure according to claim 1, wherein the rare earth element in the rare earth element oxide phases are at least one selected from the group consisting of Nd, Pr, Dy, Tb, Ho, and Gd.

* * * * *